US012151854B2

(12) United States Patent
Wommelsdorf et al.

(10) Patent No.: US 12,151,854 B2
(45) Date of Patent: Nov. 26, 2024

(54) CLOSURE CAP WITH WINGS

(71) Applicant: GEORG MENSHEN GMBH & CO. KG, Finnentrop (DE)

(72) Inventors: Jan Wommelsdorf, Kirchhundem (DE); Volker Koelsche, Schalksmuehle (DE); Leon Segref, Finnentrop (DE); Frank Roemer, Finnentrop (DE)

(73) Assignee: GEORG MENSHEN GMBH & CO. KG, Finnentrop (DE)

( * ) Notice: Subject to any disclaimer, the term of this patent is extended or adjusted under 35 U.S.C. 154(b) by 67 days.

(21) Appl. No.: 18/018,042

(22) PCT Filed: Jul. 2, 2021

(86) PCT No.: PCT/EP2021/068345
§ 371 (c)(1),
(2) Date: Jan. 26, 2023

(87) PCT Pub. No.: WO2022/022946
PCT Pub. Date: Feb. 3, 2022

(65) Prior Publication Data

US 2023/0278757 A1 Sep. 7, 2023

(30) Foreign Application Priority Data

Jul. 29, 2020 (DE) ..... 10 2020 119 965.1

(51) Int. Cl.
*B65D 41/04* (2006.01)
*B65D 41/34* (2006.01)
*B65D 75/58* (2006.01)

(52) U.S. Cl.
CPC ..... *B65D 41/0485* (2013.01); *B65D 41/3404* (2013.01); *B65D 75/5883* (2013.01); *B65D 2401/15* (2020.05)

(58) Field of Classification Search
CPC .... B65D 43/26; B65D 39/16; B65D 75/5883; B65D 75/5872; B65D 75/5861;
(Continued)

(56) References Cited

U.S. PATENT DOCUMENTS 10,647,490 B2 5/2020 Van Der Molen
D984,260 S * 4/2023 Wommelsdorf ..... D9/443
(Continued)

FOREIGN PATENT DOCUMENTS

EP 3 025 982 A1 6/2016
WO WO 2007/002292 A2 1/2007
(Continued)

*Primary Examiner* — Robert J Hicks
(74) *Attorney, Agent, or Firm* — Norman B. Thot

(57) ABSTRACT

A closure cap made of a plastic. The closure cap includes a cylindrical shell which has a lateral outer surface and a vertical axis of rotation, and wings which are arranged to protrude from the lateral outer surface and which are fastened on diametrically opposite sides of the cylindrical shell. Each of the wings transitions from a wing fastening region, which is arranged close to the cylindrical shell, into an actuation region, which adjoins the wing fastening region and which is arranged radially further distant from the cylindrical shell. The actuation region serves for a manual actuation of the closure cap. The wing fastening regions are arranged, with respect to both sides of a central plane which runs through the cap axis of rotation, rotationally symmetrical with respect to the cap axis of rotation.

12 Claims, 4 Drawing Sheets

(58) Field of Classification Search
CPC ..... B65D 41/0485; B65D 41/04; B65D 41/3404; B65D 41/34; B65D 2401/15; B65D 2401/20
USPC ..... 220/262, 212.5, 212; 215/329, 316, 215, 215/252, 250; D9/452, 435
See application file for complete search history.

(56) References Cited

U.S. PATENT DOCUMENTS

| | | | | |
|---|---|---|---|---|
| 2008/0199108 | A1 | 8/2008 | Rogers | |
| 2012/0000941 | A1 | 1/2012 | Krishnamoorthy et al. | |
| 2016/0272380 | A1 | 9/2016 | Mazurkiewicz et al. | |
| 2016/0340087 | A1 | 11/2016 | Kropf | |
| 2021/0354896 | A1* | 11/2021 | Fiere ..... | B65D 75/58 |
| 2022/0119163 | A1* | 4/2022 | Wommelsdorf ..... | B65D 55/16 |

FOREIGN PATENT DOCUMENTS

| | | | |
|---|---|---|---|
| WO | WO 2012/012097 | A2 | 1/2012 |
| WO | WO 2015/114084 | A1 | 8/2015 |
| WO | WO 2016/140668 | A1 | 9/2016 |

* cited by examiner

CLOSURE CAP WITH WINGS

CROSS REFERENCE TO PRIOR APPLICATIONS

This application is a U.S. National Phase application under 35 U.S.C. § 371 of International Application No. PCT/EP2021/068345, filed on Jul. 2, 2021 and which claims benefit to German Patent Application No. 10 2020 119 965.1, filed on Jul. 29, 2020. The International Application was published in German on Feb. 3, 2022 as WO 2022/022946 A1 under PCT Article 21(2).

FIELD

The present invention relates to a closure cap composed of plastic, having wings which protrude in particular radially from the lateral outer surface of the cap and which are fastened to the cap on diametrically opposite sides, wherein each wing transitions from the fastening region, which is situated close to the cap, into an actuation region, which adjoins further to the outside and which serves for manual actuation.

BACKGROUND

WO 2007/002292 A2 describes a screw-on closure cap on which, as grip surfaces, two wings protrude radially outward on diametrically opposite sides of the cap. In the case of a stiff thread or in the event of jamming, or in order to break a tamper-evident seal, it is often necessary to manually impart such a high rotational force to the closure cap that the grip surfaces can bend or break.

SUMMARY

An aspect of the present invention is to improve a closure cap of the type mentioned in the introduction so that it exhibits high strength and rigidity while having a simple construction. The closure cap should provide a good grip and a pleasant grip feel.

In an embodiment, the present invention provides a closure cap which is made of a plastic. The closure cap includes a cylindrical shell which comprises a lateral outer surface and a vertical axis of rotation, and wings which are arranged to protrude from the lateral outer surface and which are fastened on diametrically opposite sides of the cylindrical shell. Each of the wings transitions from a wing fastening region, which is arranged close to the cylindrical shell, into an actuation region, which adjoins the wing fastening region and which is arranged radially further distant from the cylindrical shell. The actuation region is configured to serve for a manual actuation of the closure cap. The wing fastening regions are arranged, with respect to both sides of a central plane which runs through the cap axis of rotation, rotationally symmetrical with respect to the cap axis of rotation.

BRIEF DESCRIPTION OF THE DRAWINGS

The present invention is described in greater detail below on the basis of embodiments and of the drawings in which.

DETAILED DESCRIPTION

Figure 1:
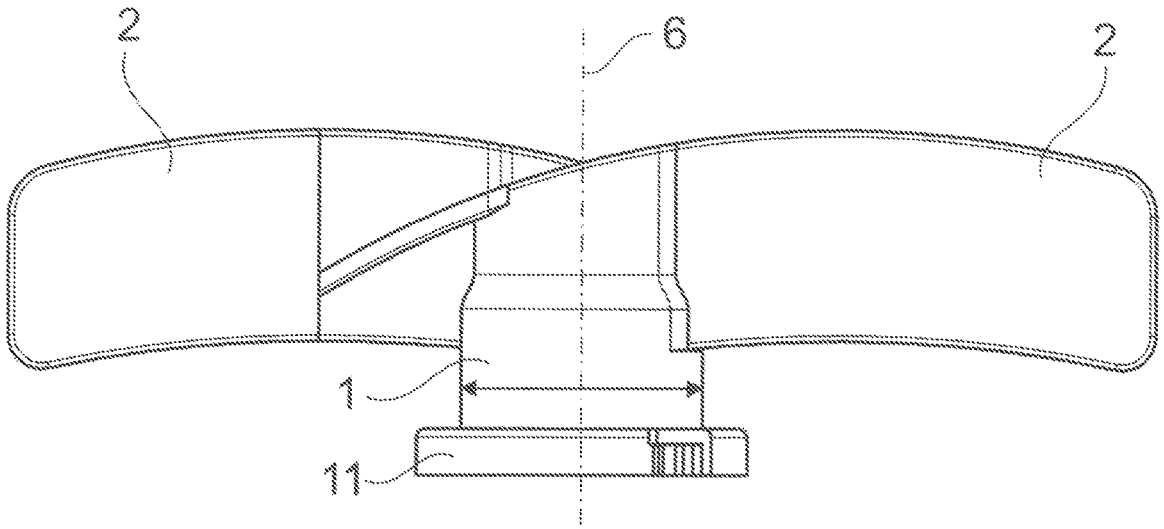
FIG. 1 shows a side view of a first exemplary embodiment of a closure cap of the present invention.

The present invention provides that the fastening regions of both wings are arranged, rotationally symmetrically with respect to the cap axis of rotation, to both sides of a central plane running through the cap axis of rotation.

A high strength of the wings on the closure cap is provided via a lateral arrangement of the fastening regions with respect to the central plane so that high rotational forces can be manually imparted to the closure cap via the wings without the wings significantly deforming or breaking. A pleasant handling is thereby also achieved.

These advantages are further improved if, in a view directed onto the lateral outer surface of the cap perpendicular with respect to the cap axis of rotation, the fastening region of each wing transitions from a concave bend region that is relatively far remote from the cap into a convex bend region that is relatively close to the cap, wherein the convex bend region lies closely against the convex lateral outer surface of the cap and/or transitions in a continuous fashion into the convex lateral outer surface of the cap.

The strength of the wings on the closure cap is further increased if at least one strut or tongue protrudes from the lateral outer surface of the cap, the outer end of which strut or tongue is formed integrally on a wing outer surface. It is here proposed that the strut or tongue is formed as a hollow shape, the cavity of which opens to the rear side of the wing. Such a hollow shape reduces weight and the expenditure of material for the closure cap, and offers a pleasant grip as a finger recess. It is furthermore proposed that rib, strut or tongue are restricted in terms of their embodiment to the concave wing fastening region, or extend beyond this into the vertical actuation region.

With regard to the two actuation regions of the wings, it is proposed, as possible embodiments:

- that both actuation regions lie in a central plane in which the cap axis of rotation lies;
- that the actuation regions are arched so that a cross section through the actuation region transversely with respect to its longitudinal extent forms an arch;
- that the actuation regions are arched in their longitudinal extent; and
- that the actuation regions are arranged parallel and with a lateral spacing to the central plane.

It is furthermore proposed that the closure cap be fastened to a pouring spout of a container via a thread, and that the closure cap be connected to the pouring spout of a container via a tamper-evident seal.

Exemplary embodiments of the present invention are illustrated in the drawings and will be described in greater detail below.

The closure cap 1 according to the present invention is produced from plastic by injection molding. The closure cap 1 has a cylindrical shell which surrounds an interior space which is closed at its top side so that the closure cap 1 can be screwed via its internal thread onto the external thread of a pouring spout of a container. Between the lower end of the closure cap 1 and the closure cap seat of the pouring spout is a tamper-evident seal 11 which breaks when the closure cap 1 is unscrewed for the first time and which thereby indicates whether the closure has already been opened.

Figure 3:
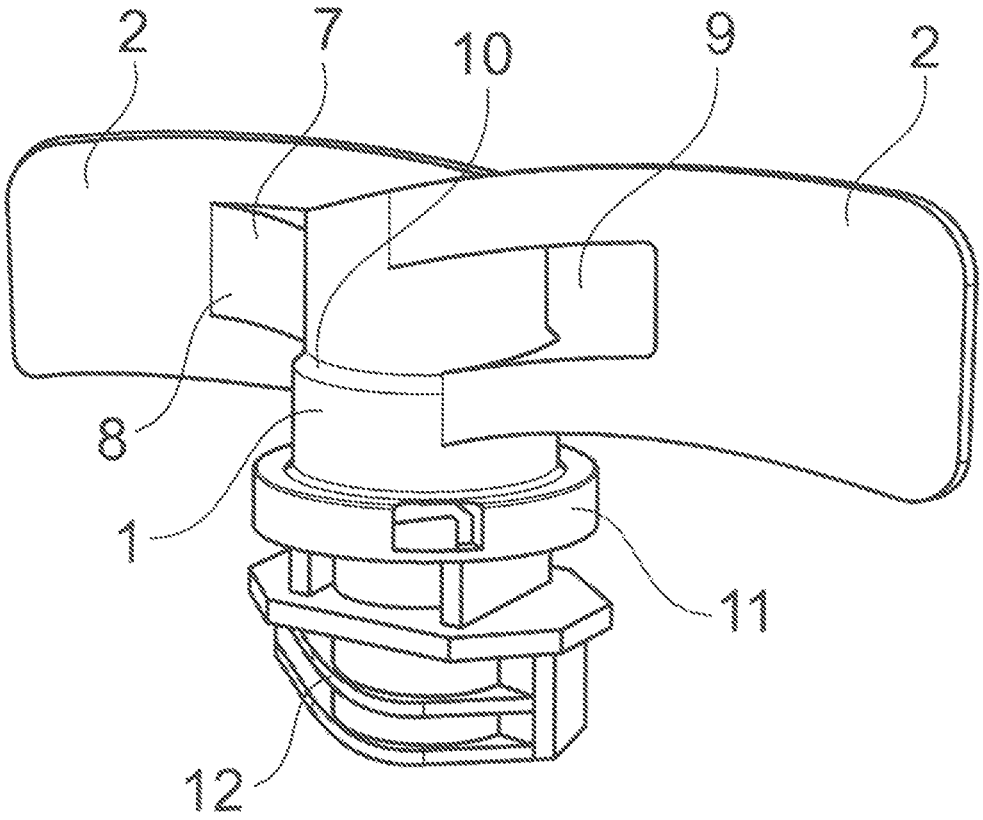
FIG. 3 shows a perspective view of a second exemplary embodiment of a closure cap of the present invention with a straight cross section through the wings in the actuation region.

In the embodiment as per FIG. 3, a boat-shaped weld-in part 12 is formed integrally on the lower end of the pouring spout, which weld-in part is welded in between the two side walls of a container in the form of a pouch.

Figure 2:
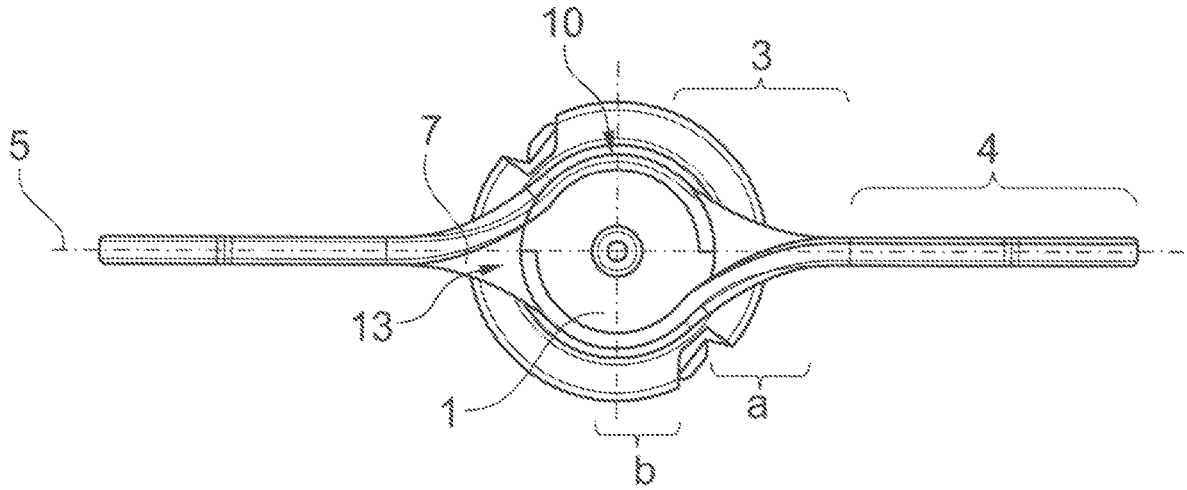
FIG. 2 shows a view from above of the first exemplary embodiment.

Two integrally formed wings 2 protrude radially from the lateral outer surface 10 of the closure cap 1 on diametrically opposite sides of the cap, which wings 2, in the embodiment as per FIGS. 1 and 2, lie in a vertical plane 5 in which the vertical axis of rotation 6 of the closure cap 1 also lies. The two wings 2 here protrude to both sides so that the closure cap 1 has a significant overall width which makes it impossible for the closure cap 1 to be swallowed by a child.

Each of the two wings 2 is, by way of a wing fastening region 3, formed integrally on the convex lateral outer surface 10 of the cap, wherein, in a view directed onto the lateral outer surface 10 of the cap perpendicularly with respect to the vertical axis of rotation 6 of the closure cap 1, the wing fastening region 3 of each wing 2 transitions from a concave bend region a that is relatively far remote from the cap into a convex bend region b that is relatively close to the cap, wherein the convex bend region b lies closely against the convex lateral outer surface 10 of the closure cap 1 and/or transitions in a continuous fashion into the convex lateral outer surface 10 of the cap. The wing fastening region 3 can thus, with its two bend regions a and b, be referred to as being S-shaped in a view from above.

Figure 4:
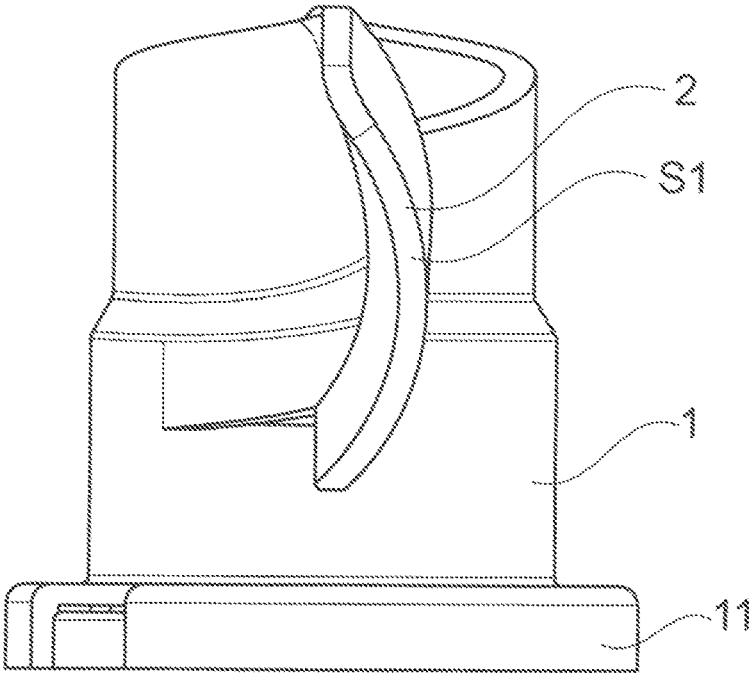
FIG. 4 shows a side view with an actuation region with circular-segment-shaped cross section.
Figure 5:
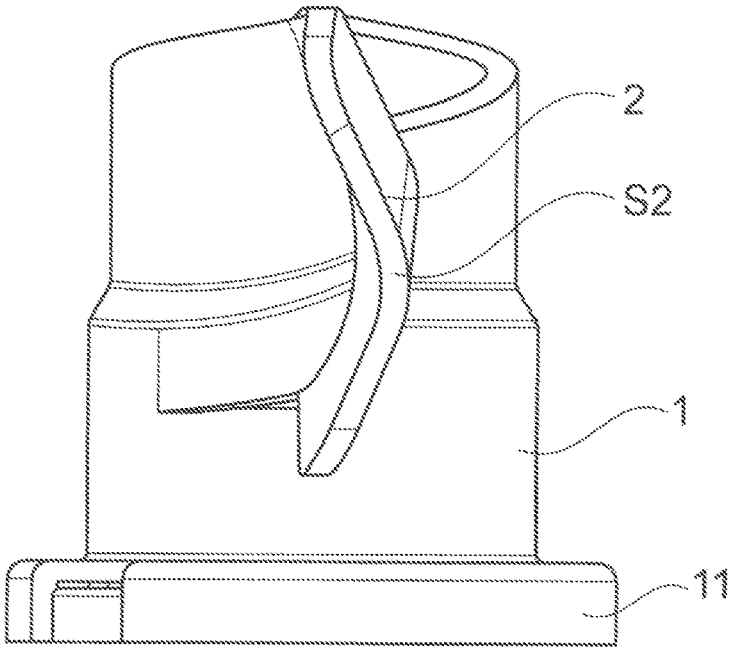
FIG. 5 shows a side view with an actuation region with a kinked cross section.
Figure 6:
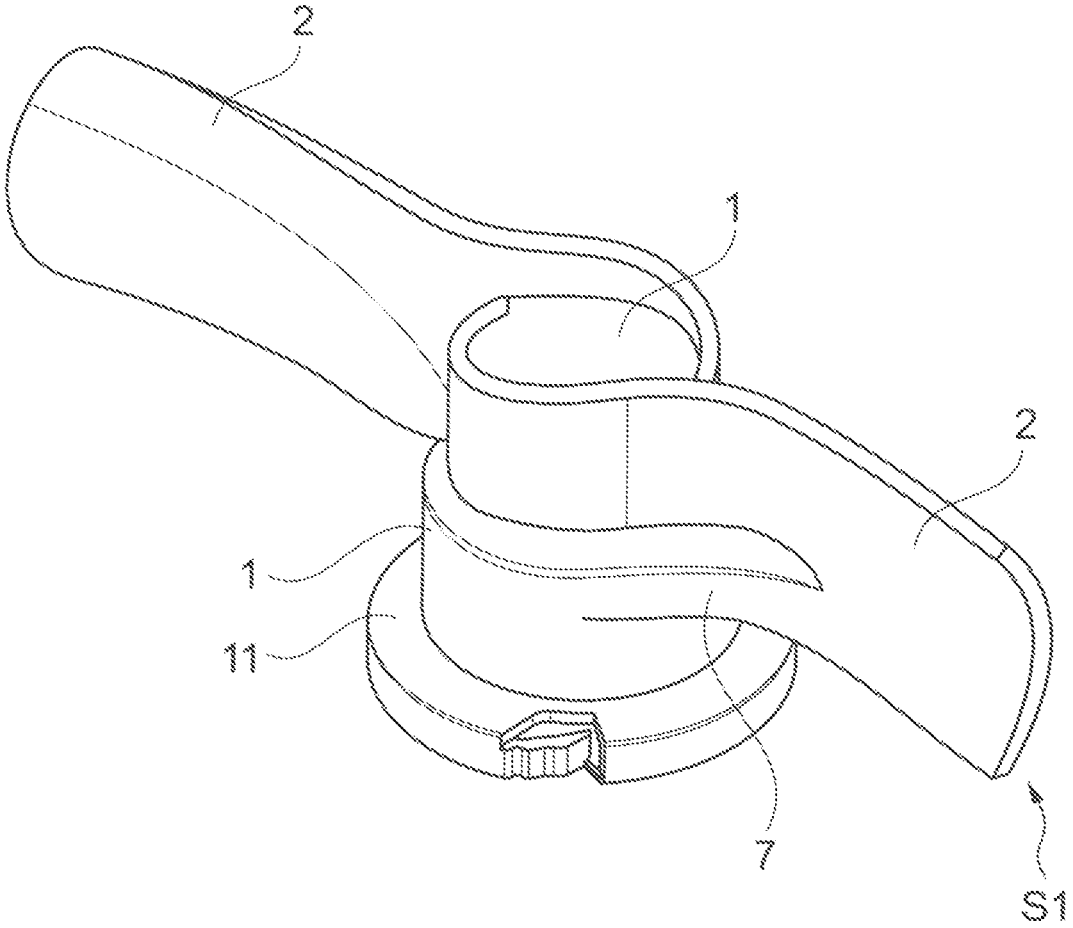
FIG. 6 shows a perspective view of a third embodiment of a closure cap of the present invention.

In the case of both wings 2, the wing fastening region 3 is adjoined to the outside by an in particular radial, laminar, vertical actuation region 4, which in the embodiment as per FIGS. 1 and 2 lies in the vertical plane 5. The vertical actuation region 4 may, however, also lie parallel and offset with respect to the vertical plane 5, and may furthermore be curved or arched in its transverse direction and/or in its longitudinal extent. Two forms of arch in the transverse direction are illustrated in FIGS. 4 and 5 and are denoted by S1 and S2.

Rib, strut or tongue 7 may be restricted in terms of their embodiment to the concave wing fastening region 3, or may extend beyond this into the vertical actuation region 4. Rib, strut or tongue 7 may also be combined in their embodiments.

In order to increase the strength and rigidity of the fastening of the two wings 2 to the closure cap 1, at least one rib, strut or tongue 7 protrudes from the outer lateral surface 10 of the closure cap 1, which rib, strut or tongue 7 extends outward, and the outer end 8 of which rib, strut or tongue 8 is formed integrally on the outer surface of a wing 2. The rib, strut or tongue 7 bridges a gap or interstice 13 that exists between the wing fastening region 3 and the lateral outer surface 10.

In the embodiment as per FIG. 3, the rib, strut or tongue 7 is formed as a hollow shape, the cavity 9 of which opens to the rear side of the wing 2. Each of the two wings 2 may also be respectively fastened by two or more ribs, struts or tongues to the lateral outer surface 10 of the closure cap 1.

The present invention is not limited to embodiments described herein; reference should be had to the appended claims.

LIST OF REFERENCE NUMERALS

1 Closure cap/Cylindrical shell
2 Wing
3 Wing fastening region
4 Vertical actuation region
5 Vertical plane
6 Vertical axis of rotation (of the closure cap 1)
7 Rib, strut or tongue
8 Outer end (of rib, strut or tongue 7)
9 Cavity
10 Lateral outer surface
11 Tamper-evident seal
12 Boat-shaped weld-in part
13 Gap or interstice
a Concave bend region
b Convex bend region
S1 Arch in the transverse direction
S2 Arch in the transverse direction

What is claimed is:

1. A closure cap made of a plastic, the closure cap comprising:
- a cylindrical shell which comprises a lateral outer surface and a vertical axis of rotation; and
- wings which are arranged to protrude from the lateral outer surface and which are fastened on diametrically opposite sides of the cylindrical shell,
- wherein,
- each of the wings transitions from a wing fastening region, which is arranged close to the cylindrical shell, into an actuation region, which adjoins the wing fastening region and which is arranged radially further distant from the cylindrical shell, the actuation region being configured to serve for a manual actuation of the closure cap,
- the wing fastening regions are arranged, with respect to both sides of a central plane which runs through the cap axis of rotation, rotationally symmetrical with respect to the cap axis of rotation, and
- when the closure cap is viewed from a top thereof along the vertical axis of rotation,
  - the wing fastening region of each of the wings transitions from a concave bend region into a convex bend region,
  - at least a part of the concave bend region is further radially distant from the cylindrical shell than the convex bend region, and
  - the convex bend region at least one of,
    - lies against the lateral outer surface of the cylindrical shell, and
    - transitions in a continuous fashion into the lateral outer surface of the cylindrical shell.

2. The closure cap as recited in claim 1, wherein the wings protrude radially from the lateral outer surface.

3. The closure cap as recited in claim 1, wherein,
- each of the wings comprises a wing outer surface, and
- the closure cap further comprises:
- at least one rib, strut or tongue which protrudes from the lateral outer surface of the cylindrical shell, an outer end of the rib, strut or tongue being formed on the wing outer surface.

4. The closure cap as recited in claim 3, wherein,
- each one of the at least one rib, strut or tongue is formed as a hollow shape comprising a cavity which opens to a rear side of the wing.

5. The closure cap as recited in claim 3, wherein each one of the at least one rib, strut or tongue is arranged in a concave part of the wing fastening region.

6. The closure cap as recited in claim 3, wherein each one of the at least one rib, strut or tongue is arranged in a concave part of the wing fastening region and in the vertical actuation region.

7. The closure cap as recited in claim 1, wherein each actuation region and the cap axis of rotation lies in the central plane.

8. The closure cap as recited in claim 1, wherein each actuation region is arched so that a cross section through the actuation region transversely with respect to a longitudinal extent thereof forms an arch.

9. The closure cap recited in claim 1, wherein each actuation region is arched in a longitudinal extent thereof.

10. The closure cap recited in claim 1, wherein each actuation region is arranged parallel to and with a lateral spacing to the central plane.

11. The closure cap recited in claim 1, further comprising:

a thread, wherein the closure cap is fastened to a pouring spout of a container via the thread.

12. The closure cap recited in claim 11, further comprising:

a tamper-evident seal, wherein the closure cap is connected to the pouring spout of the container via the tamper-evident seal.

* * * * *